US009259747B2

(12) United States Patent
Erickson

(10) Patent No.: US 9,259,747 B2
(45) Date of Patent: Feb. 16, 2016

(54) MULTI-FUNCTION SPRAYHEAD

(71) Applicant: Kohler Co., Kohler, WI (US)

(72) Inventor: Perry D. Erickson, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 24 days.

(21) Appl. No.: 14/143,884

(22) Filed: Dec. 30, 2013

(65) Prior Publication Data

US 2014/0191064 A1 Jul. 10, 2014

Related U.S. Application Data

(60) Provisional application No. 61/748,940, filed on Jan. 4, 2013.

(51) Int. Cl.

| | |
|---|---|
| ***B05B 1/32*** | (2006.01) |
| ***B05B 1/16*** | (2006.01) |
| ***B05B 1/30*** | (2006.01) |

(52) U.S. Cl.

CPC ..... *B05B 1/326* (2013.01); *B05B 1/1636* (2013.01); *B05B 1/3026* (2013.01); *Y10T 137/86549* (2015.04); *Y10T 137/86863* (2015.04)

(58) Field of Classification Search

CPC .... B05B 1/326; B05B 1/1636; B05B 1/3026; B05B 1/14; B05B 1/1645; B05B 1/1654; B05B 1/1663; B05B 1/169; Y10T 137/86549; Y10T 137/86863; Y10T 137/9464; F16K 11/0743; F16K 11/0787; F16K 27/045

USPC ..... 239/391, 392, 395, 396, 436, 437, 442, 239/443, 445–449; 137/625.4, 625.46, 137/625.17, 625.18; 4/601, 678

See application file for complete search history.

(56) References Cited

U.S. PATENT DOCUMENTS

| | | | | |
|---|---|---|---|---|
| 3,346,148 | A | | 10/1967 | Weese |
| 3,739,983 | A | | 6/1973 | Jousson |
| 4,617,965 | A | * | 10/1986 | Lorch ..... 137/625.17 |
| 4,651,770 | A | | 3/1987 | Denham et al. |
| 4,765,540 | A | | 8/1988 | Yie |
| 4,794,952 | A | | 1/1989 | Burkard |

(Continued)

FOREIGN PATENT DOCUMENTS

| | | | |
|---|---|---|---|
| CA | 2155433 | A1 | 7/1994 |
| CN | 201651426 | U | 11/2010 |

(Continued)

OTHER PUBLICATIONS

European Search Report and Search Opinion for Application No. EP 14150082, dated Apr. 7, 2014, 5 pages.

*Primary Examiner* — John Fox
*Assistant Examiner* — Michael R Reid
(74) *Attorney, Agent, or Firm* — Foley & Lardner LLP

(57) ABSTRACT

A fluid control valve, the fluid control valve including a first disc, a fluid inlet, and a second disc slidably coupled to the first disc and movable relative thereto, the second disc located between the fluid inlet and the first disc. The first disc includes a first outlet port coupled to a first outlet, a second outlet port coupled to a second outlet, and a third outlet port coupled to a third outlet. Movement in a first direction of the second disc relative to the first disc fluidly couples the fluid inlet to at least one of the first outlet port, the second outlet port, and the third outlet port, and wherein movement in a second direction of the second disc relative to the first disc controls the volume of fluid flowing from through the valve.

6 Claims, 22 Drawing Sheets

(56) References Cited

U.S. PATENT DOCUMENTS

| | | | | |
|---|---|---|---|---|
| 5,022,429 | A | 6/1991 | Rollini et al. | |
| 5,577,664 | A | 11/1996 | Heitzman | |
| 5,772,120 | A | 6/1998 | Huber | |
| 5,806,771 | A | 9/1998 | Loschelder et al. | |
| 5,918,811 | A * | 7/1999 | Denham et al. | 239/437 |
| 5,961,046 | A | 10/1999 | Joubran | |
| 6,202,693 | B1 | 3/2001 | Bollo | |
| 6,367,710 | B2 * | 4/2002 | Fan | 239/381 |
| 6,533,194 | B2 | 3/2003 | Marsh et al. | |
| 6,607,148 | B1 | 8/2003 | Marsh et al. | |
| 6,634,380 | B2 | 10/2003 | Bartkus et al. | |
| 6,659,372 | B2 | 12/2003 | Marsh et al. | |
| 6,959,731 | B2 | 11/2005 | Bartkus et al. | |
| 7,070,125 | B2 | 7/2006 | Williams et al. | |
| 7,134,614 | B2 | 11/2006 | Miyake et al. | |
| 7,322,535 | B2 | 1/2008 | Erdely | |
| 7,344,094 | B1 | 3/2008 | Tracy et al. | |
| 7,373,950 | B2 | 5/2008 | Huang | |
| 7,487,797 | B2 | 2/2009 | Di Nunzio | |
| 7,494,074 | B2 | 2/2009 | Benstead | |
| 7,753,074 | B2 | 7/2010 | Rosko et al. | |
| 7,762,479 | B2 | 7/2010 | Li | |
| 7,770,820 | B2 | 8/2010 | Clearman et al. | |
| 7,789,326 | B2 | 9/2010 | Luettgen et al. | |
| 7,871,020 | B2 | 1/2011 | Nelson et al. | |
| 8,113,442 | B2 | 2/2012 | Li et al. | |
| 2002/0148516 | A1 * | 10/2002 | Bartkus et al. | 137/625.46 |
| 2005/0001072 | A1 | 1/2005 | Bolus et al. | |
| 2007/0246577 | A1 | 10/2007 | Leber | |
| 2008/0156902 | A1 | 7/2008 | Luettgen et al. | |
| 2009/0236438 | A1 | 9/2009 | Petrovic | |
| 2010/0006169 | A1 | 1/2010 | Bolgar et al. | |
| 2010/0125946 | A1 | 5/2010 | Meisner et al. | |
| 2010/0276518 | A1 | 11/2010 | Kajuch | |
| 2011/0147477 | A1 | 6/2011 | Mang | |
| 2011/0198415 | A1 | 8/2011 | Ukigai et al. | |
| 2011/0198416 | A1 | 8/2011 | Ukigai et al. | |
| 2011/0284662 | A1 | 11/2011 | Ohashi et al. | |

FOREIGN PATENT DOCUMENTS

| | | | |
|---|---|---|---|
| CN | 102160765 | | 8/2011 |
| CN | 102161023 | | 8/2011 |
| CN | 102316778 | | 1/2012 |
| DE | 28 43 666 | A1 | 4/1980 |
| EP | 0 688 607 | A1 | 12/1995 |
| EP | 2 359 726 | A1 | 8/2011 |
| EP | 2 361 688 | A1 | 8/2011 |
| EP | 2 361 689 | A1 | 8/2011 |
| JP | 2010-162356 | | 7/2010 |
| JP | 2010-162532 | | 7/2010 |
| JP | 2010-162534 | | 7/2010 |
| JP | 2010-162535 | | 7/2010 |
| JP | 04-623329 | | 2/2011 |
| JP | 2011-167355 | | 9/2011 |
| JP | 2011-167640 | | 9/2011 |
| WO | WO-94/07065 | | 3/1994 |
| WO | WO-95/17971 | | 7/1995 |
| WO | WO-01/70904 | | 9/2001 |

* cited by examiner

MULTI-FUNCTION SPRAYHEAD

CROSS-REFERENCE TO RELATED APPLICATIONS

The present application claims priority to and the benefit of U.S. Provisional Patent Application No. 61/748,940, filed Jan. 4, 2013, which is incorporated herein by reference in its entirety.

BACKGROUND

The present disclosure relates generally to the field of valves for directing fluids to multiple outlets. More specifically, the disclosure relates to sprayhead assemblies for use in faucets for directing fluid (e.g., water) to one or more outlets to thereby provide multiple functions of the sprayhead.

Faucets may include a body and a sprayhead from which water is emitted. Conventional sprayheads may include a valve for switching between two functions, for example, aerated and non-aerated water streams. There is a need for an improved valve to distribute water between functional outlets. There is a further need for a valve that provides a sprayhead having more than two functions.

SUMMARY

One embodiment relates to a fluid control valve, the fluid control valve including a first disc, a fluid inlet, and a second disc slidably coupled to the first disc and movable relative thereto, the second disc located between the fluid inlet and the first disc. The first disc includes a first outlet port coupled to a first outlet, a second outlet port coupled to a second outlet, and a third outlet port coupled to a third outlet. Movement in a first direction of the second disc relative to the first disc fluidly couples the fluid inlet to at least one of the first outlet port, the second outlet port, and the third outlet port, and wherein movement in a second direction of the second disc relative to the first disc controls the volume of fluid flowing from through the valve.

Another embodiment relates to a sprayhead, the sprayhead including a body having a first end and a second end opposite the first end, a fluid inlet proximate the first end, a fluid outlet proximate the second end, a first disc fixed to the body, and a second disc moveably coupled to the body. Rotation of the second disc relative to the first disc causes a first response, and wherein translation of the second disc relative to the first disc causes a second response.

Another embodiment relates to a sprayhead, the sprayhead including a cartridge, an outlet disc fixed relative to the cartridge, and a movable disc. The outlet disc includes an inlet side and an outlet side having a first outlet port, a second outlet port, and a third outlet port. The movable disc includes an inlet side fluidly coupled to a fluid inlet and includes an outlet side adjacent and movable relative to the inlet side of the outlet disc. The movable disc defines a passageway extending from the inlet side of the movable disc to the outlet side of the movable disc Movement in a first direction of the movable disc relative to the outlet disc fluidly couples the fluid inlet to at least one of the first outlet port, the second outlet port, and the third outlet port, and wherein movement in a second direction of the movable disc relative to the outlet disc controls the volume of fluid flowing from through the sprayhead.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, will become apparent in the detailed description set forth herein and taken in conjunction with the accompanying drawings.

DETAILED DESCRIPTION

Figure 1:
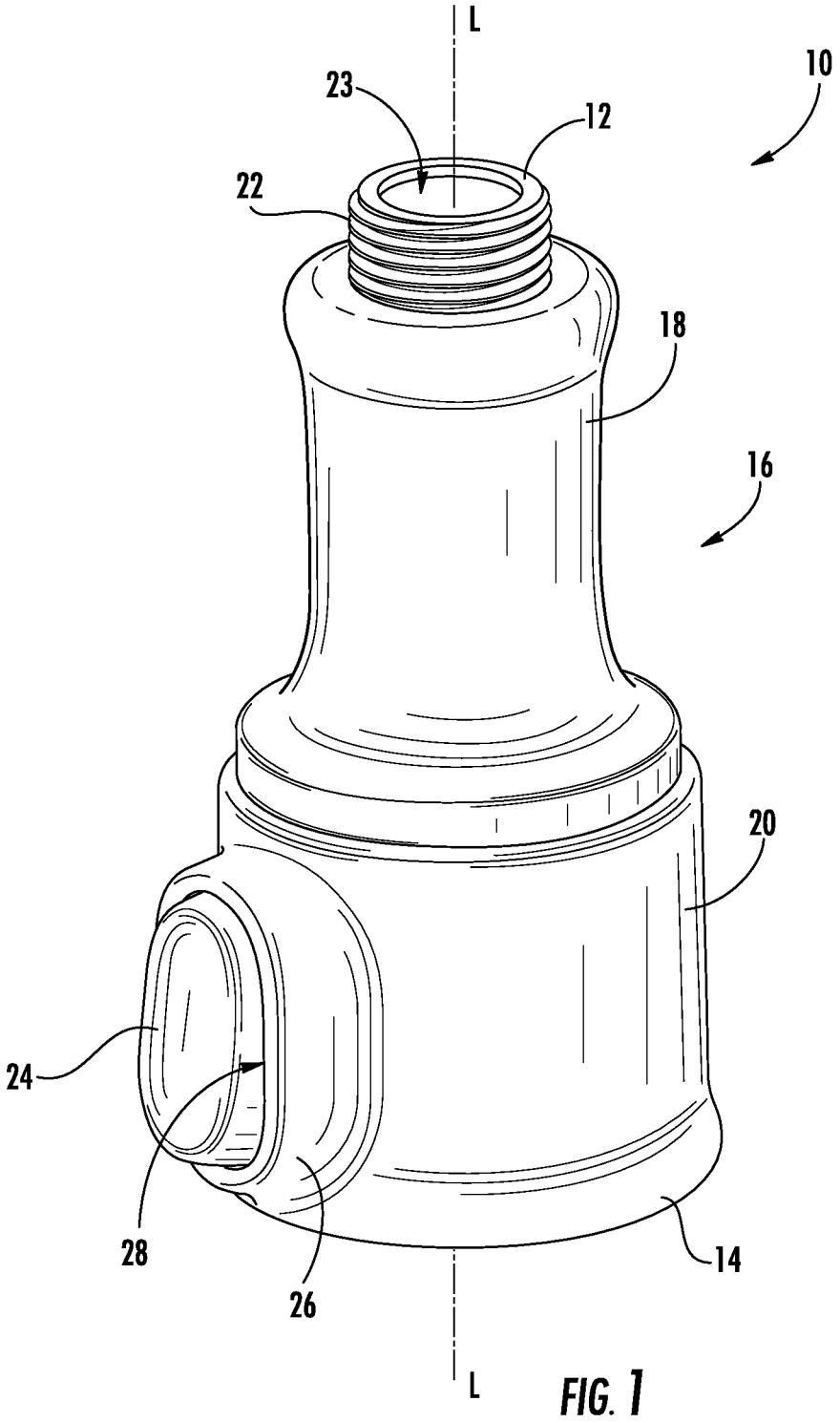
FIG. 1 is a top, front, right perspective view of a sprayhead, shown according to an exemplary embodiment.

Referring generally to the FIGURES, a sprayhead and components thereof are shown according to an exemplary embodiment. The sprayhead includes a first disc and a second disc, which is movable relative to the first disc. When the second disc is moved in a first direction (e.g., translation, rotation, etc.) relative to the first disc, the volume of fluid flow through the sprayhead is controlled. When the second disc is moved in a second direction (e.g., rotation, translation, etc.) relative to the first disc, the function (e.g., spray pattern, spray pulsation, etc.) is controlled.

To facilitate relative movement of the first and second discs, the first and second discs are located in a body having a first or upper body portion and a second or lower body portion. The first disc is fixed relative to the upper body portion, and the second disc is rotationally fixed relative to the lower body portion. Thus, relative rotation of the upper and lower body portions causes relative rotation of the first and second discs. An actuator coupling the body and the second disc may be used to cause translation of the second disc relative to the first disc.

A conventional faucet sprayhead may include a valve which directs water between an aerated outlet and a non-aerated outlet. However, as faucet technology improves and specialized spray patterns may be used to more efficiently use water, there is a need for a valve which can distribute water to multiple functional outlets. According to various embodiments, the sprayhead has three or more possible functions. According to the exemplary embodiment shown, the sprayhead has three possible functions.

Before discussing further details of the sprayhead and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Letters in the reference numerals in the present disclosure are generally used to indicate a particular flow path to which the object of that reference numeral is associated. The objects of similarly numbered reference numerals may or may not have similar structure. For example, outlets 32*a*, 32*b*, and 32*c* are part of the first, second, and third flow paths, respectively, and may or may not be of the same size, shape or configuration.

Figure 2:
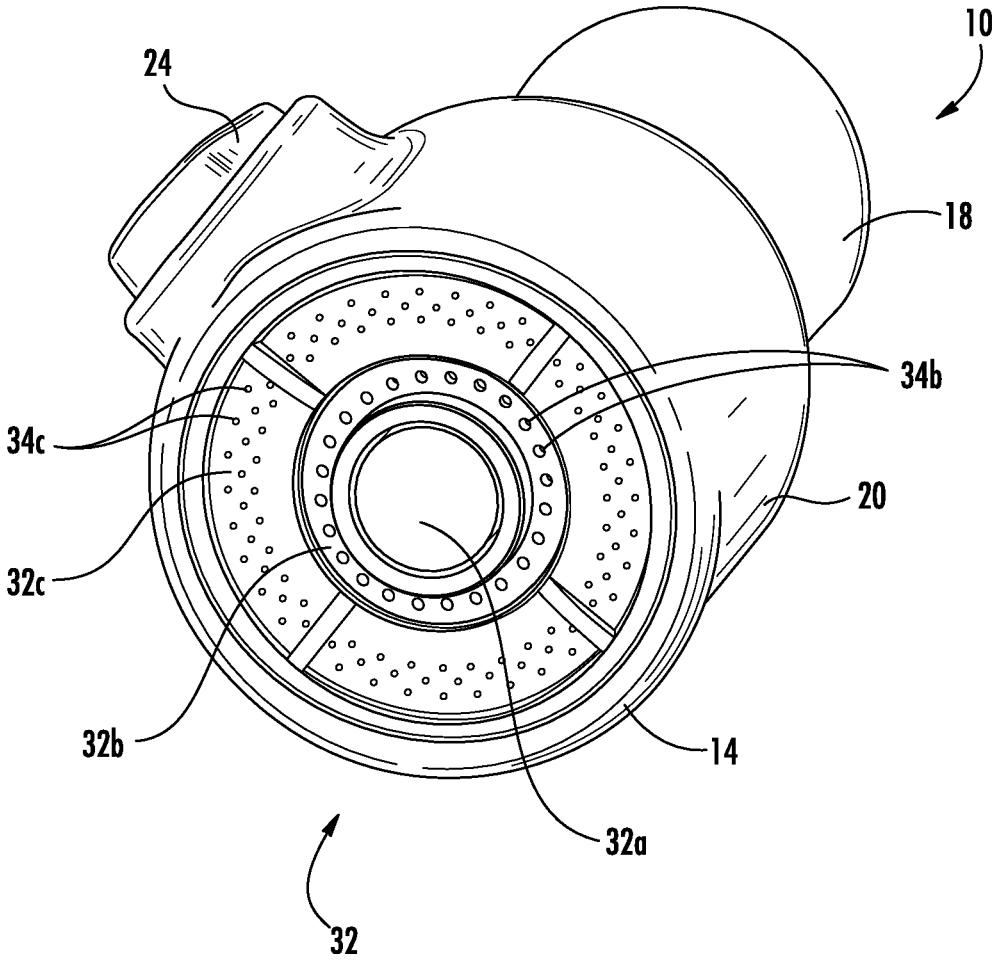
FIG. 2 is a bottom front right perspective view of the sprayhead of FIG. 1.
Figure 3:
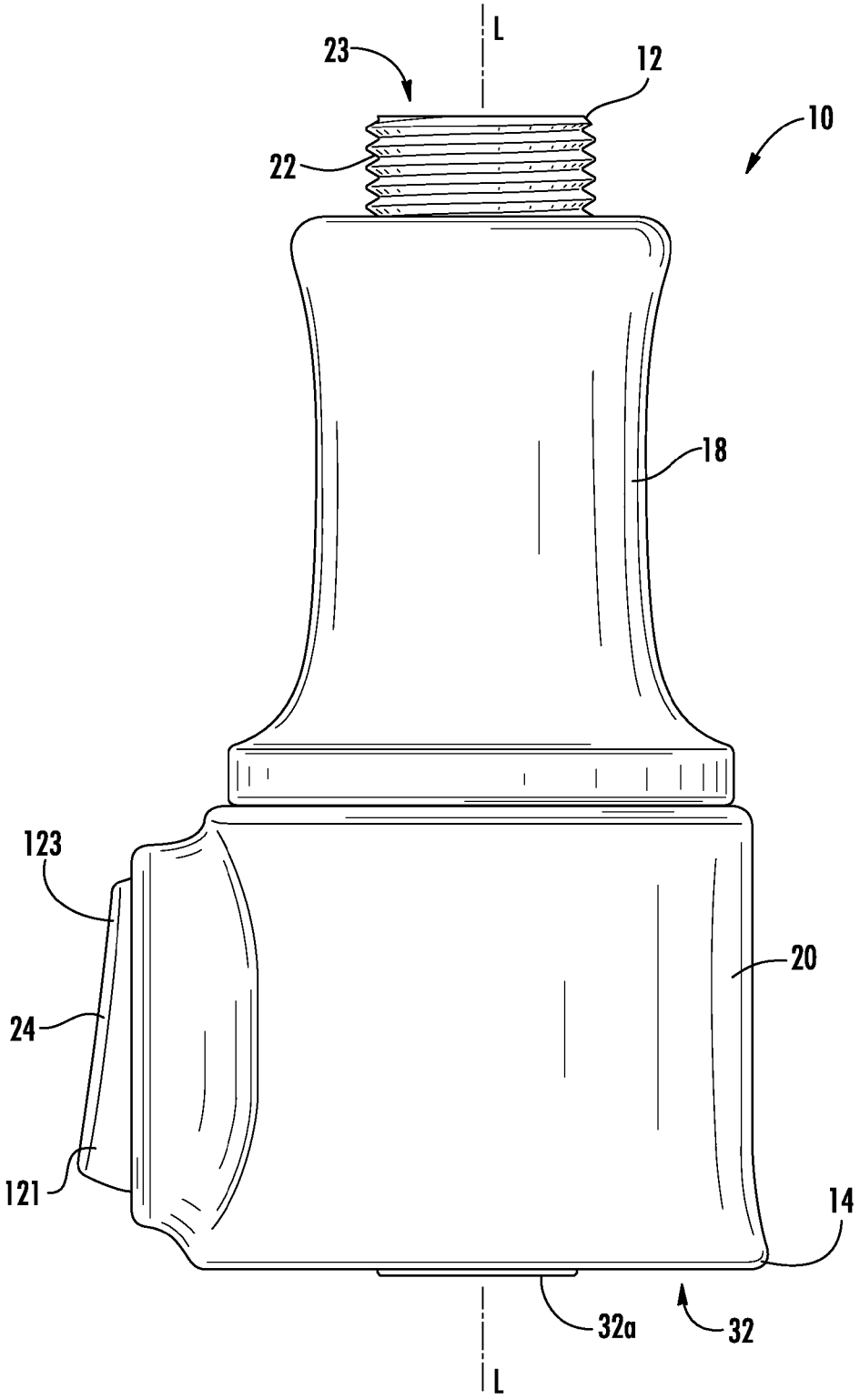
FIG. 3 is a right elevation view of the sprayhead of FIG. 1.

Referring to FIGS. 1-3, a sprayhead 10 is shown to extend axially along an axis "L" from a first or top or inlet end 12 to a second or bottom or outlet end 14. The sprayhead 10 includes a body 16 having a first or upper body portion 18 and a second or lower body portion 20 rotatably coupled to the upper body portion 18. The sprayhead 10 is further shown to include a connector 22 that is proximate the inlet end 12 and is configured to couple the sprayhead 10 to a faucet (not shown). The connector 22 defines an inlet 23 for receiving a fluid (e.g., water) into the sprayhead 10. According to an exemplary embodiment, the connector 22 threadably couples to a hose extending through the spout of the faucet such that the sprayhead 10 is fluidly coupled to the faucet. The connection allows the sprayhead 10 to be decoupled from the faucet and the hose extracted from the spout, and allows the hose to be retracted into the spout and the sprayhead 10 to be coupled to the faucet. The sprayhead 10 further includes an actuator (e.g., toggle, switch, etc.), shown as button 24, coupled to the lower body portion 20. According to the exemplary embodiment, the lower body portion 20 includes a button housing portion 26 having one or more studs 28 (e.g., bosses, protrusions, axles, etc.) that extend through one or more openings 30 (see FIG. 12) and allow the button 24 to pivot thereupon. Actuation of the button 24 causes a change in operation (e.g., volume control, function control, etc.) of the sprayhead 10, as will be described in more detail below with respect to the exemplary embodiment.

Referring to FIG. 2, fluid flows from the inlet 23 to one or more outlets (e.g., first outlet 32*a*, second outlet 32*b*, third outlet 32*c*, etc.), generally referred to as outlet 32, which are located proximate the bottom end 14. Each of the outlets 32 may have the same or different functions. For example, according to the exemplary embodiment, the first outlet 32*a* provides an aerated stream of fluid from the sprayhead 10. The second outlet 32*b* provides a spray of fluid through a plurality of orifices 34*b* to form a defined shaped spray pattern having a shaped spray arrangement having a focal length. As shown, the orifices 34*b* are oriented in various directions such that the streams of water exiting the orifices 34*b* form a wedge shape having a defined spray pattern in a focal region that is configured at a predetermined focal length from the second outlet 32*b*. An example of such an outlet is shown and described in U.S. patent application Ser. No. 13/359,089, which is incorporated by reference herein in its entirety. The third outlet 32*c* provides another spray of fluid through a plurality of orifices 34*c*. As shown, the orifices 34*c* are arranged in a different pattern than the orifices 34*b* of the second outlet 32*b*. For example, the orifices 34*c* may provide substantially parallel streams or may provide an array of parallel and outward trajectory streams so as to provide a non-intersecting shower of streams of fluid.

It is contemplated that any of the outlets 32 may have any of the features described above, or may have any other function of water. Further, the orifices 34*b*, 34*c* may or may not include a nozzle coupled to or integrally formed in each of the orifices 34*b*, 34*c*. The different outlets may be configured for or used for different purposes, for example, pot filling, hand washing, dish washing, rinsing, power washing, etc., which may be performed better with different spray patterns and/or flow pressures or velocities.

Figure 4:
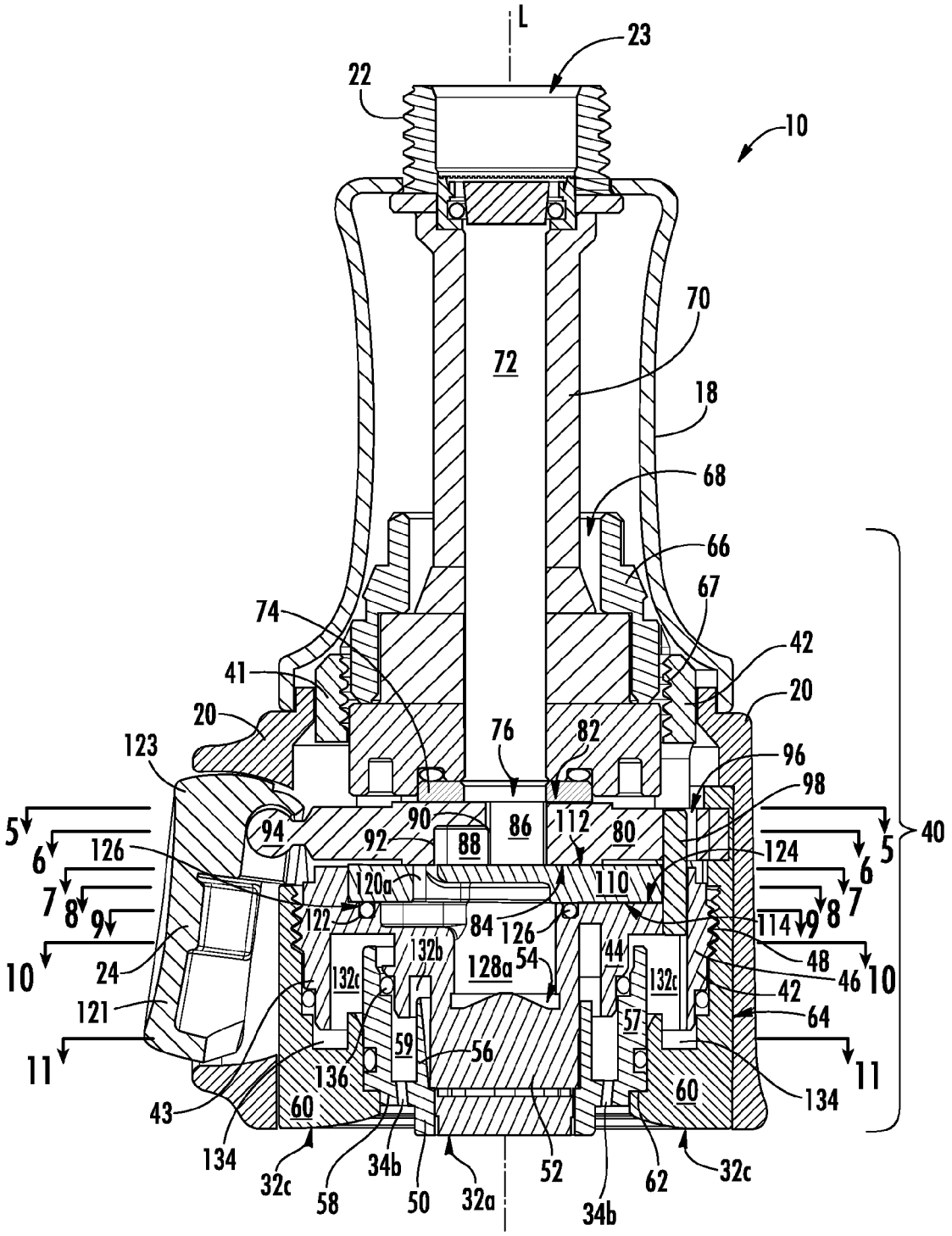
FIG. 4 is a right cross-sectional view of the sprayhead of FIG. 1.

Referring to FIG. 4, a cross-section of sprayhead 10 is shown according to an exemplary embodiment. A cartridge 40 is received in the body 16 and includes a cartridge body 42 having a first or upper or inlet end 41 and a second or lower or outlet end 43 opposite the inlet end. The outlet end 43 of the cartridge body 42 includes an inner portion 44 configured to extend into an adapter 50, which supports an aerator 52. The outlet end 43 of the cartridge body 42 further includes an outer portion 46 having threads 48 which are configured to threadably couple to a cartridge bottom 60. The cartridge bottom 60 includes the third outlet 32*c* and includes an annular ledge 62 configured to retain the adapter 50 within the cartridge 40. An outer surface 64 of the cartridge bottom 60 may also provide a surface about or along which the lower body portion 20 of the sprayhead 10 may slide when rotated.

The inlet end 41 of the cartridge body 42 is coupled to an annular collar 66 (e.g., cap, etc.), for example, via internal threads 67. The collar 66 defines a bore 68 (e.g., opening, passageway, etc.), through which extends a tube 70 (e.g., conduit, hose, etc.). The tube 70 is coupled to the connector 22 and defines a channel or bore 72 that transports fluid from the inlet 23, through the upper body portion 18, to a third or inlet disc 74. The inlet disc 74 defines a passageway or bore 76 extending axially through the inlet disc 74. The bore 76 receives fluid from the bore 72 in the tube 70 and transports the fluid through the inlet disc 74. The inlet disc 74 may be a ceramic disc, and according to the exemplary embodiment, is fixed relative to the tube 70.

Figure 5:
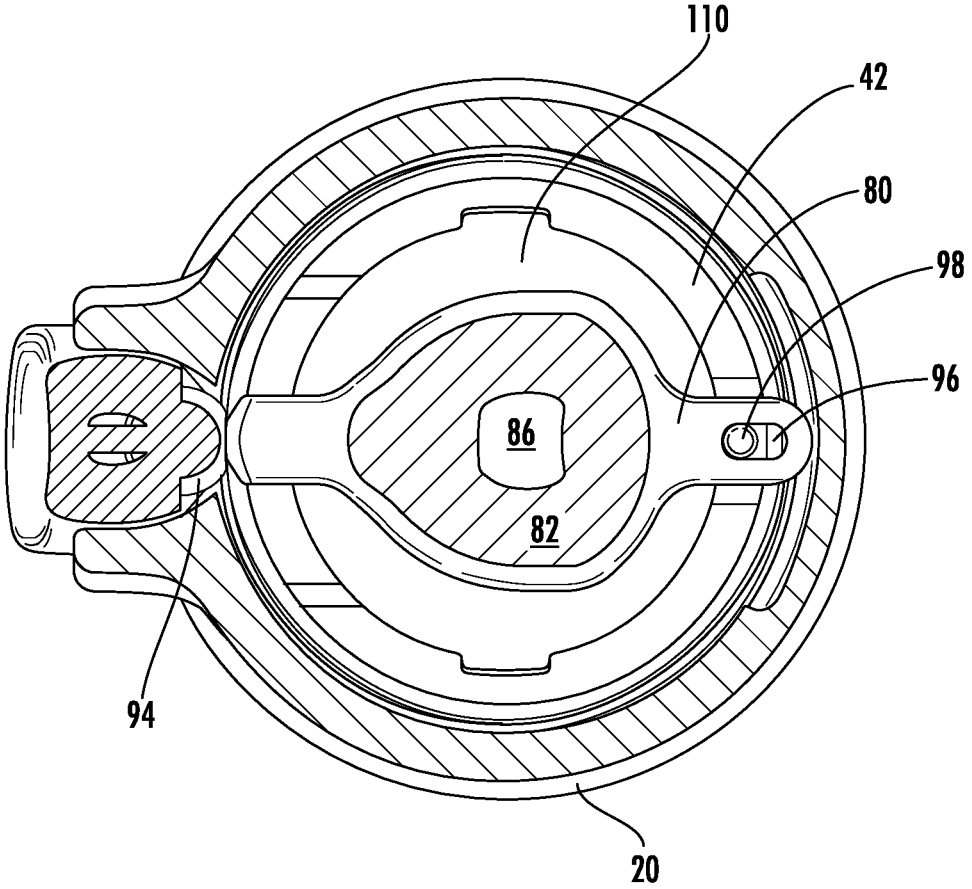
FIG. 5 is a top cross-sectional view of the sprayhead through line 5-5 of FIG. 4.
Figure 6:
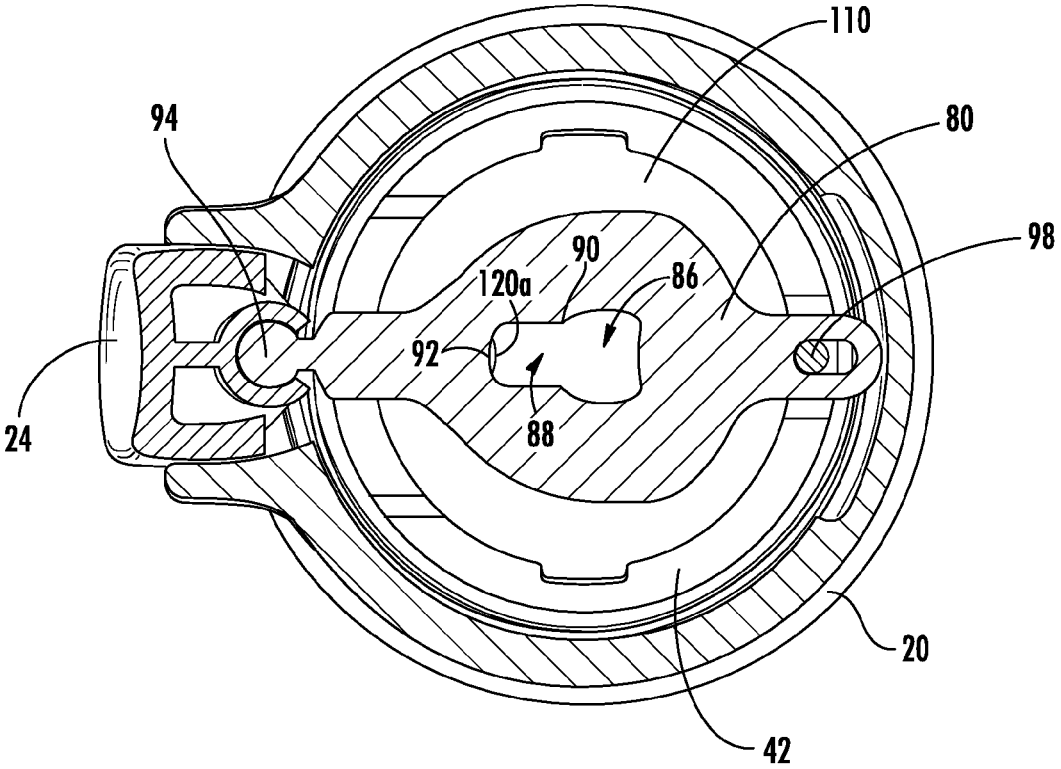
FIG. 6 is a top cross-sectional view of the sprayhead through line 6-6 of FIG. 4.

Further referring to FIGS. 5 and 6, a second or movable disc 80 (e.g., a ceramic disc, etc.) includes a second or inlet side 82 slidably coupled and adjacent to the inlet disc 74 and a first or outlet side 84 opposite the inlet side 82. A bore 86 extends at least partially through the movable disc 80 from the inlet side 82 toward the outlet side 84. According to the embodiment shown, the bore 86 extends axially completely through the movable disc 80. A channel 88 extends radially along the outlet side 84 from a first end 90 fluidly coupled to the bore 86 to a second end 92 opposite the first end 90. A first lateral end of the movable disc 80 couples to the button 24, which facilitates rotational and radial movement of the movable disc 80 relative to the inlet disc 74 and a first or outlet disc 110. According the exemplary embodiment, the first lateral end of the movable disc 80 includes a ball 94 which engages a socket located on the button 24. A second lateral end of the movable disc 80 includes an opening 96 (e.g., hole, passageway, bore, etc.) for receiving a pin 98 that is fixed relative to the cartridge 40. As shown, the pin 98 is fixed to the cartridge body 42. The pin 98 limits lateral or radial motion of the movable disc 80, thereby preventing accidental disassembly or excessive dislocation of the movable disc 80. The pin 98 further limits rotational motion of the movable disc 80, thereby creating a pivot about which movable disc 80 rotates.

Figure 12:
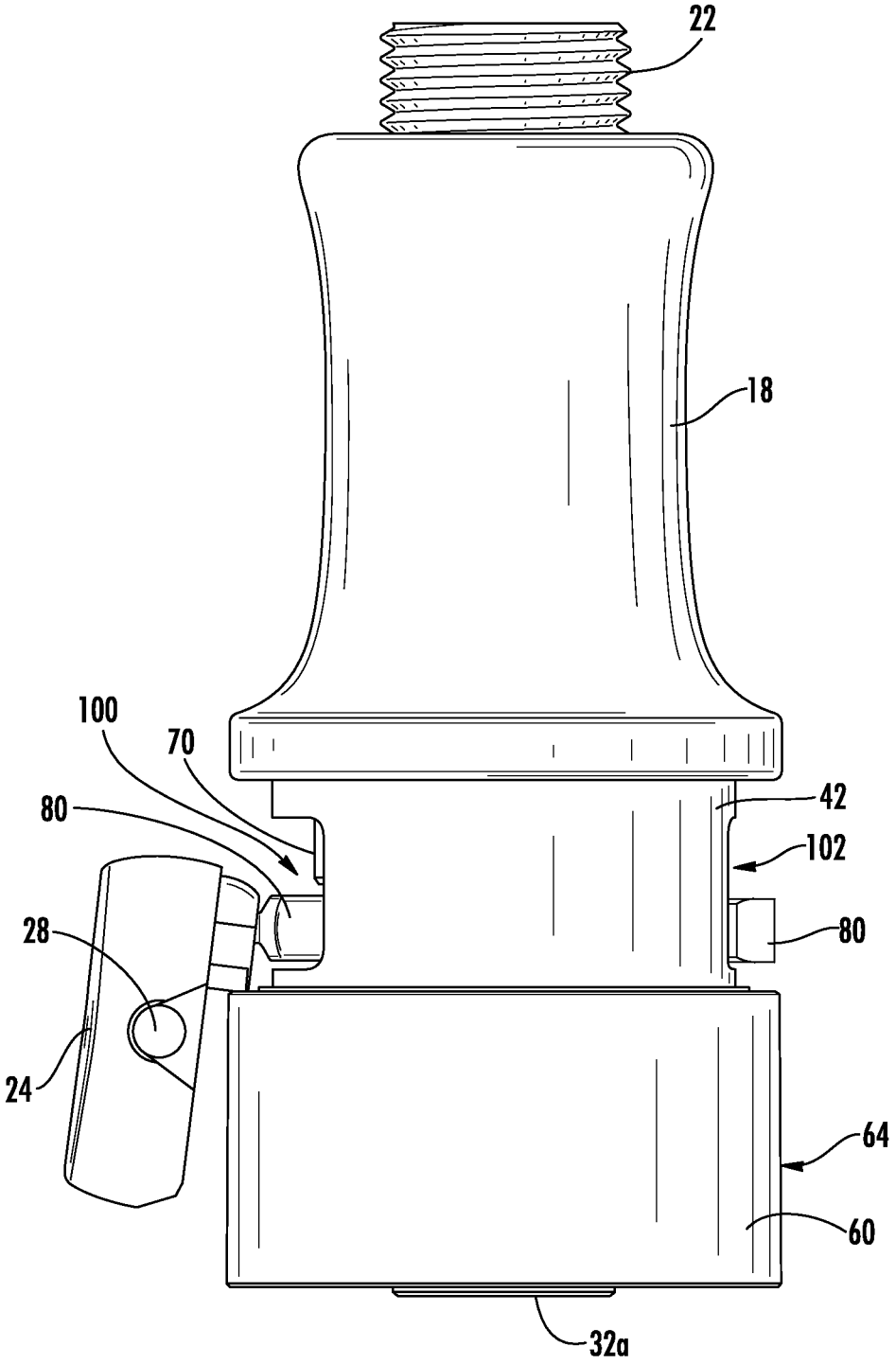
FIG. 12 is a right elevation view of the sprayhead of FIG. 1 having a bottom body portion removed.
Figure 13:
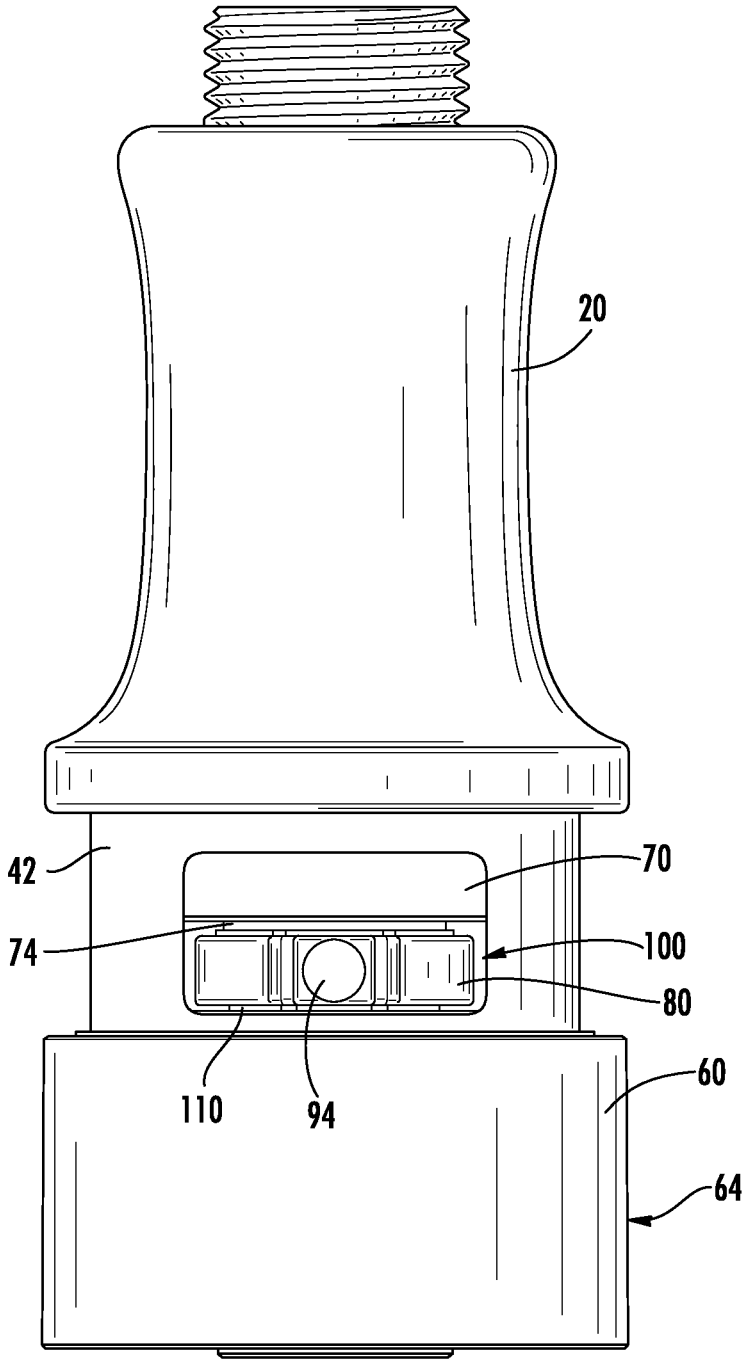
FIG. 13 is a front elevation view of the sprayhead of FIG. 1 having a bottom body portion and actuator removed.

Referring briefly to FIGS. 12 and 13, portions of the sprayhead 10 are shown according to an exemplary embodiment. FIG. 12 shows a right elevation view, and FIG. 13 shows a front elevation view, of the sprayhead 10 having the lower body portion 20 removed. Cartridge body 42 defines a front opening 100 and a rear opening 102 which permit the movable disc 80 to translate and rotate therethrough.

Figure 7:
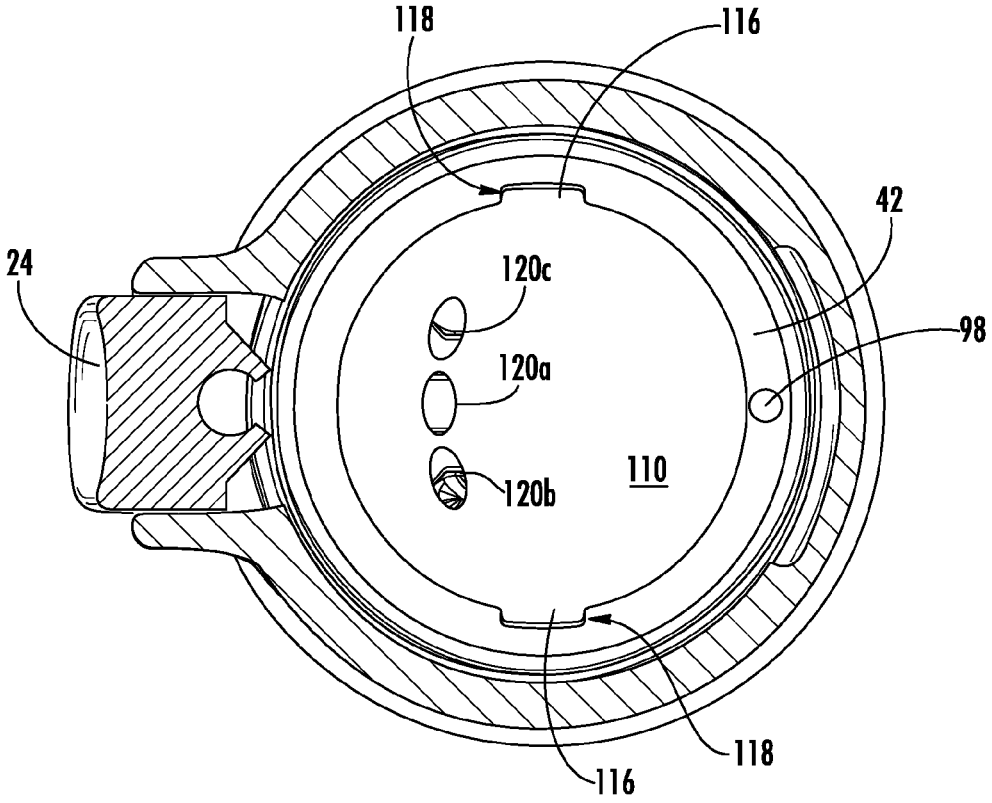
FIG. 7 is a top cross-sectional view of the sprayhead through line 7-7 of FIG. 4.
Figure 8:
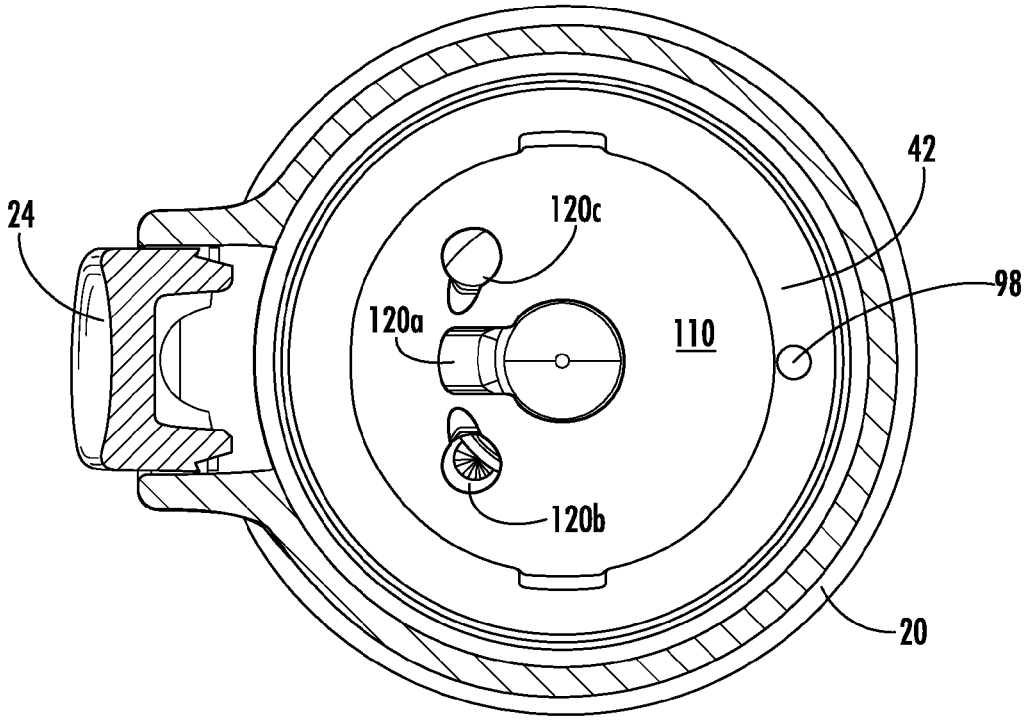
FIG. 8 is a top cross-sectional view of the sprayhead through line 8-8 of FIG. 4.

Further referring to FIGS. 7 and 8, the outlet disc 110 is fixed relative to the cartridge 40 and includes a second or inlet side 112 adjacent to the outlet side 84 of the movable disc 80. The outlet disc 110 and the movable disc 80 are slidably coupled at the interface of the inlet side 112 of the outlet disc and the outlet side 84 of the movable disc 80 allowing relative movement therebetween (e.g., rotational, circumferential, lateral, radial, translational, etc.). The outlet disc 110 further includes a first or outlet side 114 opposite the inlet side 112. At least one tab 116 is received in a slot 118 defined by the cartridge body 42. The engagement of the tab 116 and the slot 118 fixes the outlet disc 110 relative to the cartridge 40.

The outlet disc 110 includes a plurality of outlet ports 120, shown as a first outlet port 120*a*, which is fluidly coupled to the first outlet 32*a;* a second outlet port 120*b*, which is fluidly coupled to the second outlet 32*b*; and a third outlet port 120*c*, which is fluidly coupled to the third outlet 32*c*. As shown, the outlet ports 120 each have an oval shape on the inlet side 112 of the outlet disc 110. As the outlet ports 120 pass or extend through the outlet disc 110, the outlet ports 120 move towards, and change shape to interface with, a corresponding passageway in the cartridge body 42. For example, the first outlet port 120*a* extends inward towards a round opening proximate the center of the outlet disc 110, thereby forming a substantially pear or key-shaped opening. The second and third outlet ports 120*b*, 120*c* extend outwardly or circumferentially from the substantially circular openings on the outlet side 114 of the outlet disc 110. According to other embodiments, the outlet ports 120 may have any of a variety of shapes, which may or may not be the same for all of the outlet ports 120.

Figure 14:
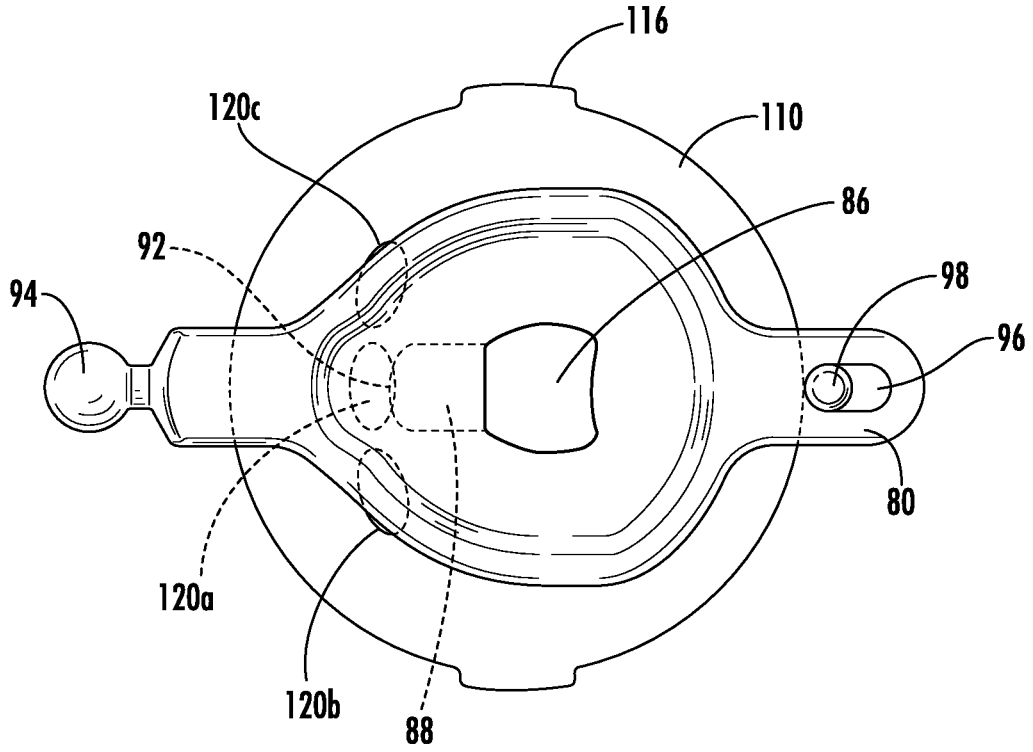
FIG. 14 is a top view of components of the sprayhead of FIG. 1, according to an exemplary embodiment.
Figure 15:
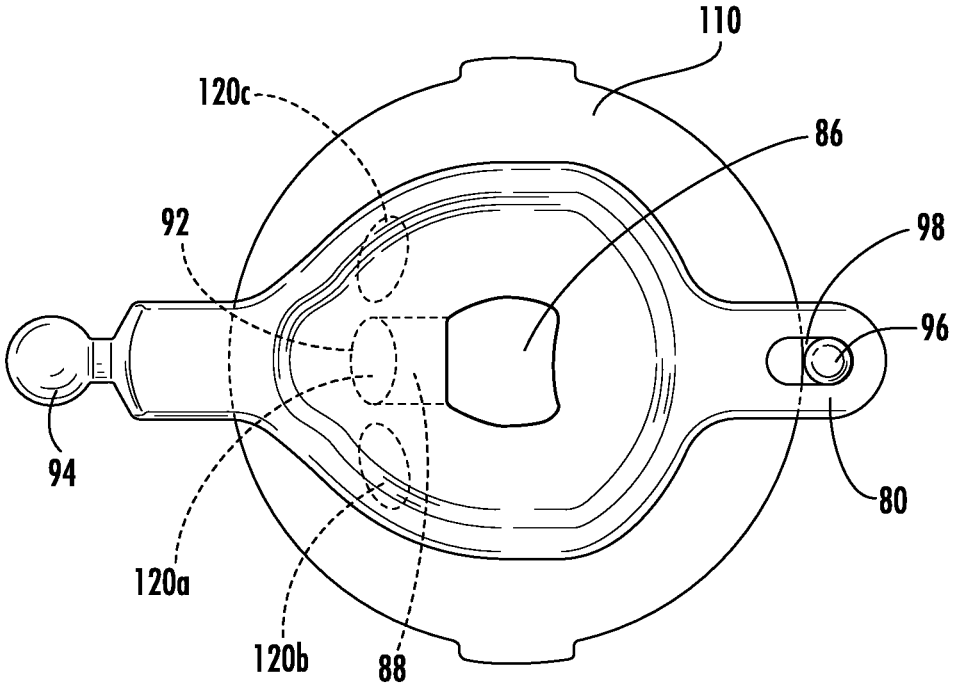
FIG. 15 is a top view of components of FIG. 14 in another position.

Referring to FIGS. 4, 14, and 15, during operation the sprayhead 10, actuation of the button 24 causes the button 24 to move the movable disc 80 in a lateral or radial direction relative to the outlet disc 110. Applying an inward force to a bottom portion 121 of the button 24 causes the button 24 to rotate about a pivot (e.g., studs 28) and causes an upper portion 123 of the button 24 to move outward. As the upper portion 123 of the button 24 moves outward, the button 24 pulls the ball 94, which in turn pulls the movable disc 80 from a first position, shown for example in FIG. 14, to a second position, shown for example in FIG. 15. As the movable disc 80 moves from the first position to the second position, the channel 88 passes over the at least one of the outlet ports 120 such that the channel 88 progressively overlaps the at least one of the outlet ports 120. As the channel 88 progressively overlaps the at least one of the outlet ports 120, the size of the passageway between the channel 88 and the outlet port 120 increases, thereby permitting an increased volume of fluid to flow therethrough.

Figure 18:
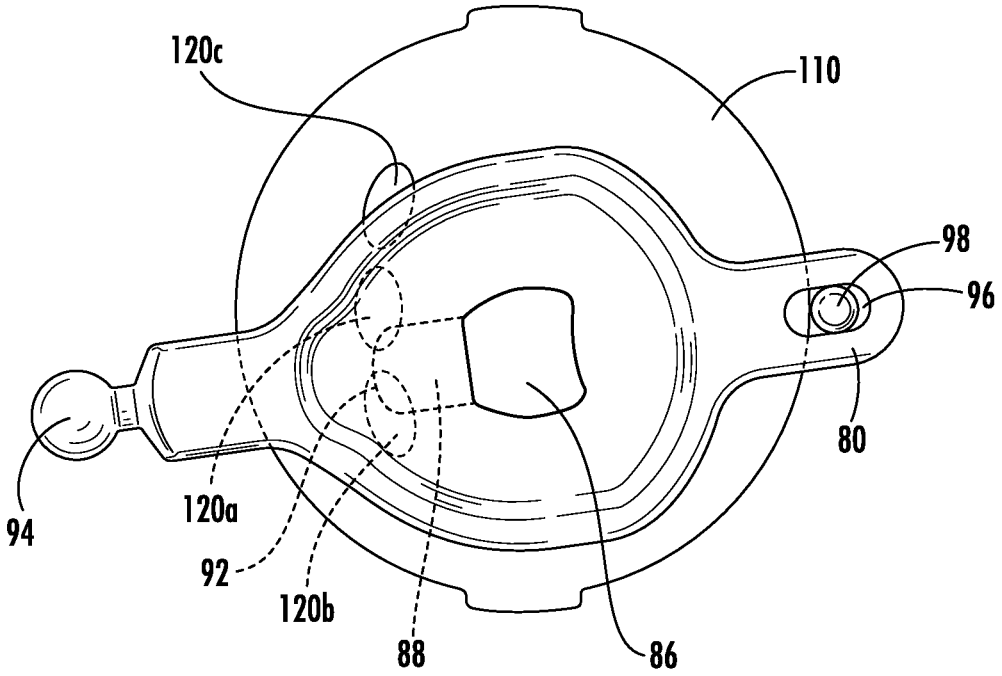
FIG. 18 is a top view of components of FIG. 14 in another position.
Figure 19:
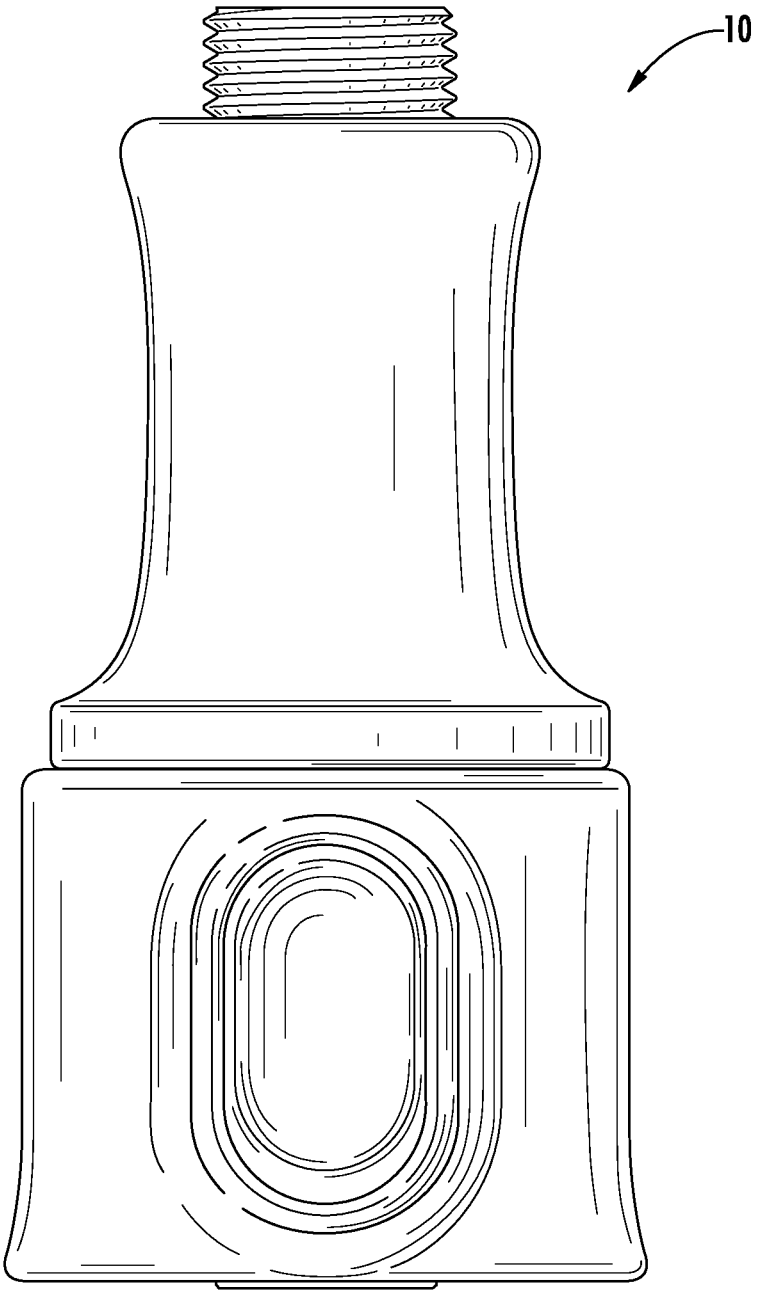
FIG. 19 is a front elevation view of the sprayhead of FIG. 1.
Figure 20:
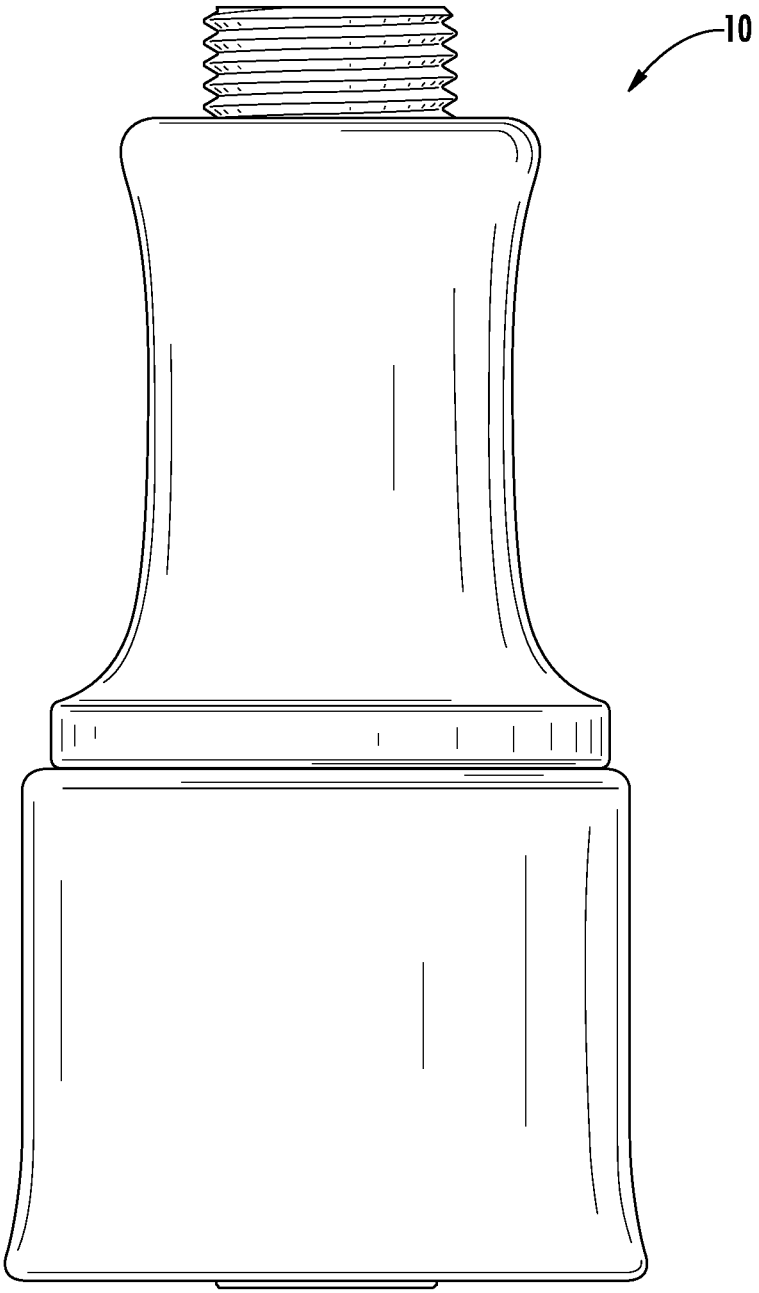
FIG. 20 is a rear elevation view of the sprayhead of FIG. 1
Figure 21:
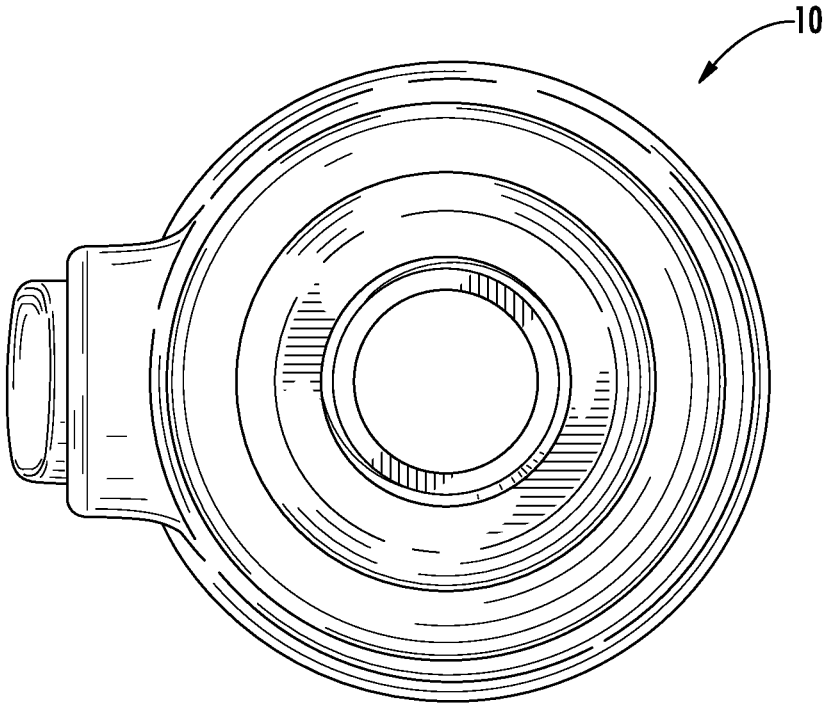
FIG. 21 is a top plan view of the sprayhead of FIG. 1
Figure 22:
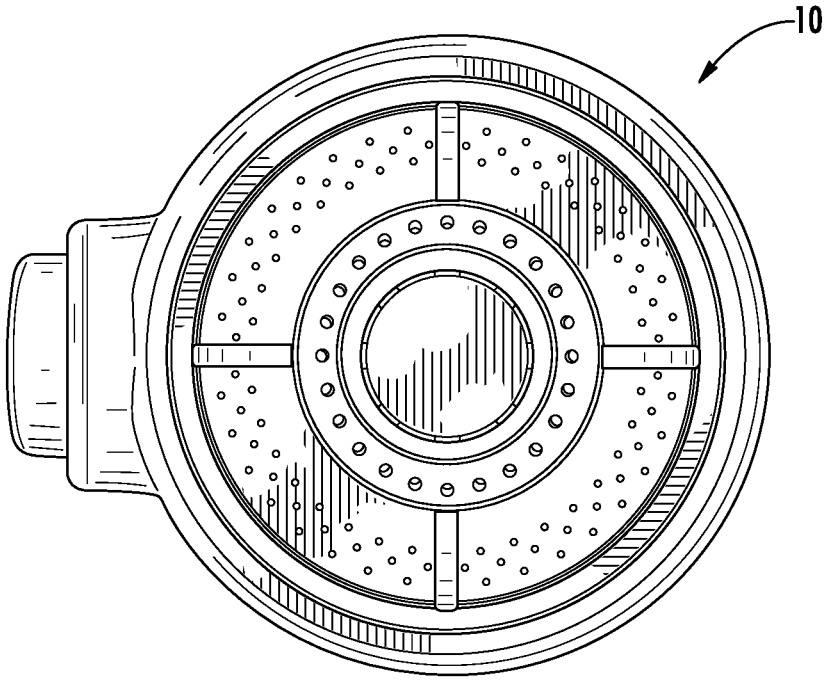
FIG. 22 is a bottom plan view of the sprayhead of FIG. 1.
Figure 23:
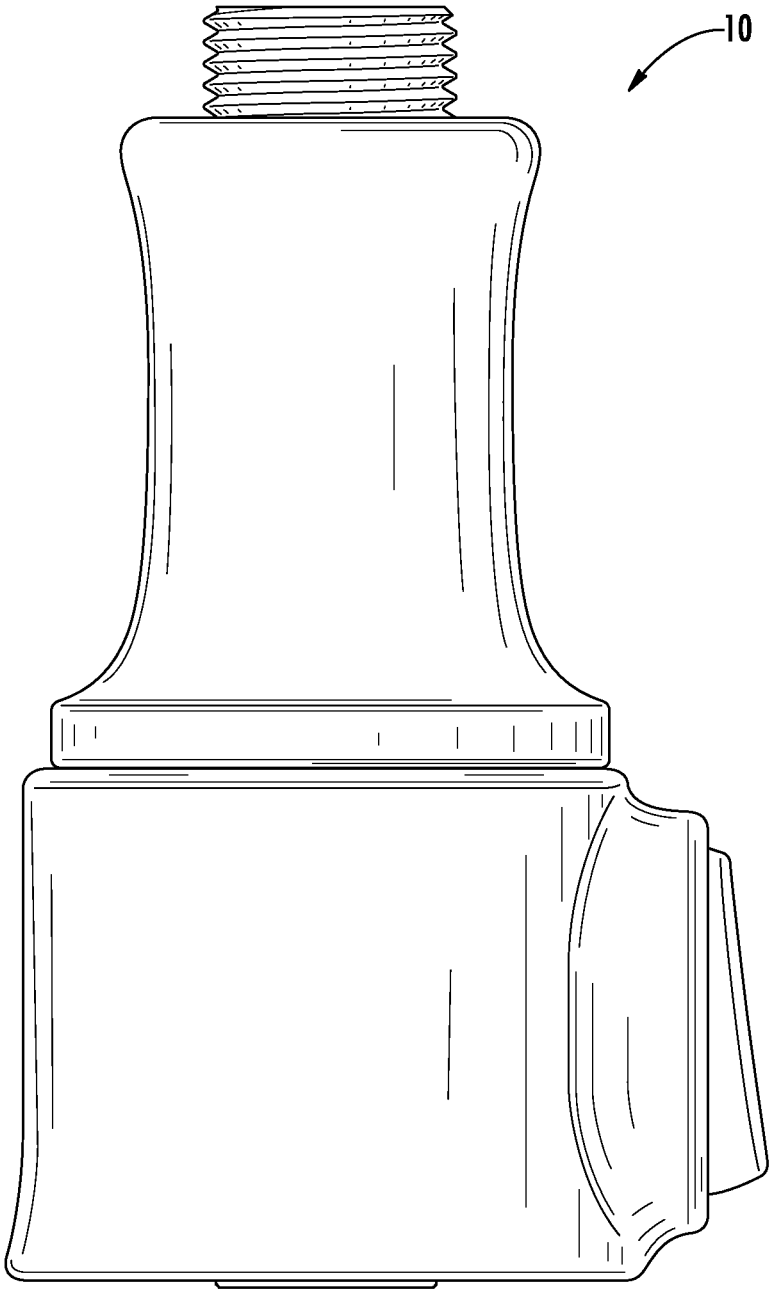
FIG. 23 is a left elevation view of the sprayhead of FIG. 1.

When an inward force is applied to the upper portion of the button 24, the lateral force is transferred through the ball 94 to move the movable disc 80 in the opposite direction as described above. As the movable disc moves from the second position towards the first position, the second end 92 of the channel 88 passes over the at least one of the outlet ports 120 such that the overlap between the channel 88 and the at least one of the outlet ports 120 progressively diminishes, thereby reducing the opening between the channel 88 and the outlet ports 120, which in turn reduces the volume of fluid passing therethrough. Translation of the movable disc 80 between the first and second positions may be continuous, thus providing continuously variable control of the volume of fluid flow. For example, FIG. 18 shows the movable disc 18 in an intermediary position which allows a flow volume somewhere between minimum flow and maximum flow. Accordingly, motion of the movable disc in a first direction (e.g., radial, lateral, etc.) controls the volume of fluid flowing through the sprayhead 10.

Figure 16:
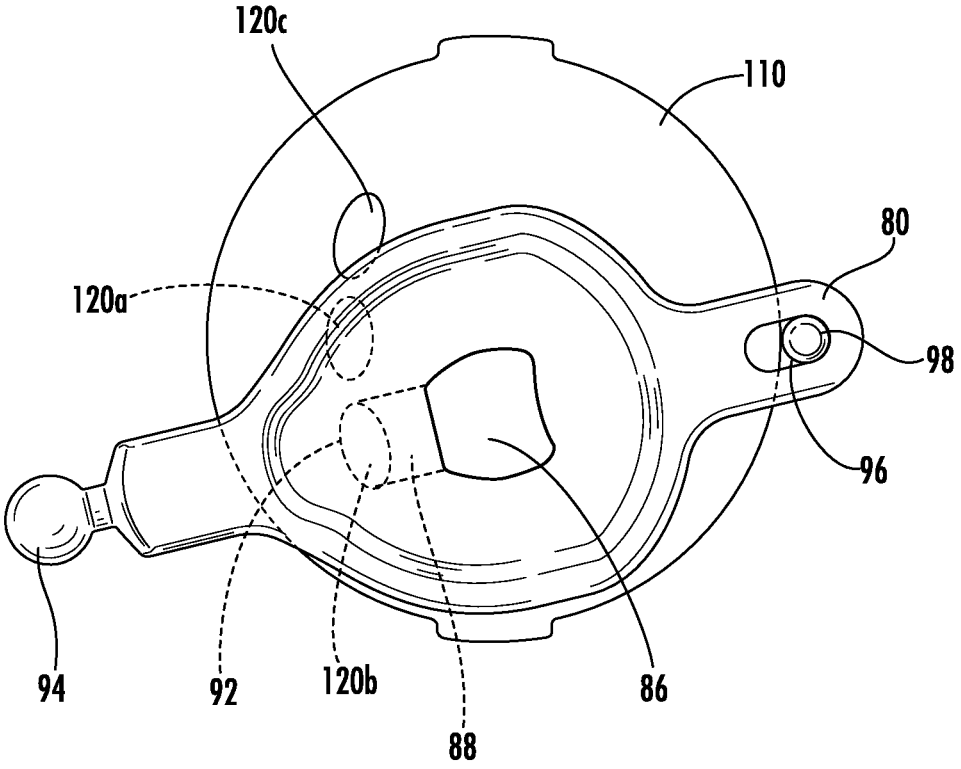
FIG. 16 is a top view of components of FIG. 14 in another position.
Figure 17:
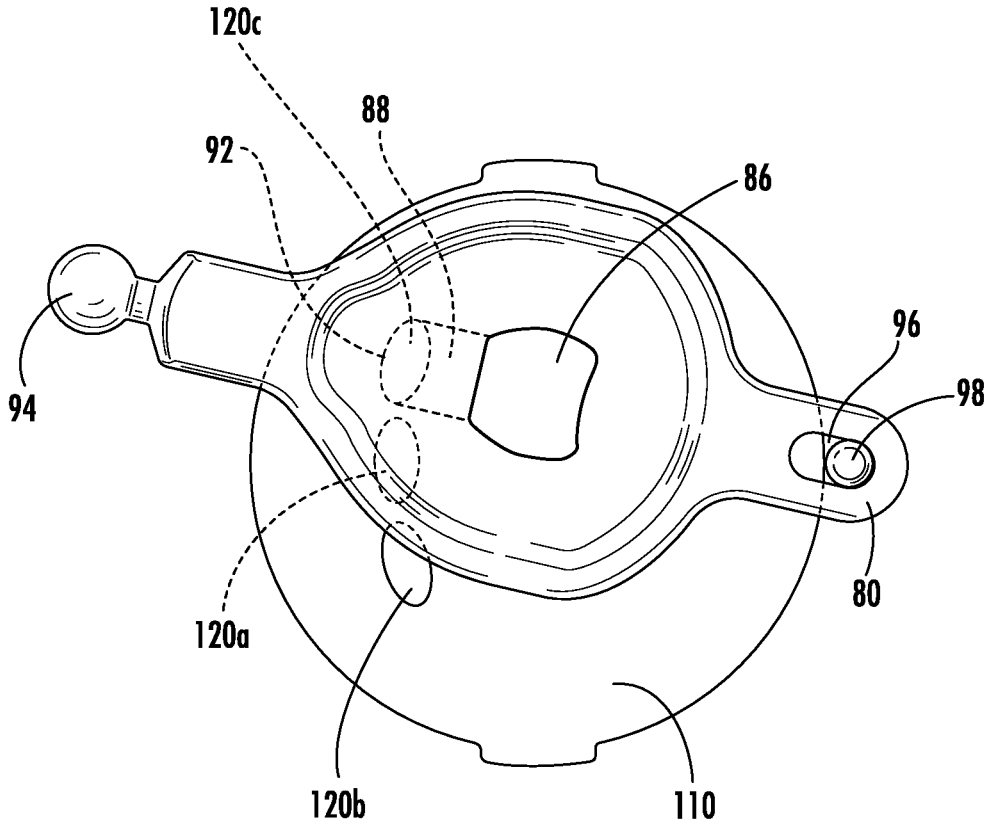
FIG. 17 is a top view of components of FIG. 14 in another position.

Referring to FIGS. 4, 16, and 17, rotating the lower body portion 20 of the sprayhead 10 relative to the upper body portion 18 causes the button housing portion 26 of the lower body portion 20 to apply a rotational or circumferential force on the button 24, thereby causing the button 24 to move rotationally or circumferentially. The rotational forces are transferred through the ball 94 of the movable disc 80 and cause the movable disc 80 to rotate about the pin 98. Rotation of the movable disc 80 about the pin 98 changes the radial alignment of the channel 88 relative to the outlet ports 120. For example, referring to FIG. 16, counterclockwise rotation of the movable disc 80 causes the channel 88 to align with the outlet port 120*b*, which in turn causes any fluid flowing through the channel 88 to pass into the outlet port 120*b* and to subsequently exit the sprayhead through the second outlet 32*b*. Alternatively, referring to FIG. 17, clockwise rotation of the movable disc 80 causes the channel 88 to align with the outlet ports 120*c*, which in turn causes any fluid flowing from the channel 88 to enter the outlet ports 120*c* and to subsequently exit the sprayhead 10 through the third outlet 32*c*.

According to the embodiment shown, rotation of the movable disc 80 is continuous so that the channel 88 may be aligned with one of the outlet ports 120*a*, 120*b*, 120*c*, or may be aligned to at least partially overlap multiple outlet ports 120, for example, outlet ports 120*a* and 120*b* (see FIG. 18) or outlet ports 120*a* and 120*c*. According to other embodiments, rotation the movable disc 80 may be in quantum increments. For example, detents may be used to align the channel 88 with one of the outlet ports 120 at a time.

Figure 9:
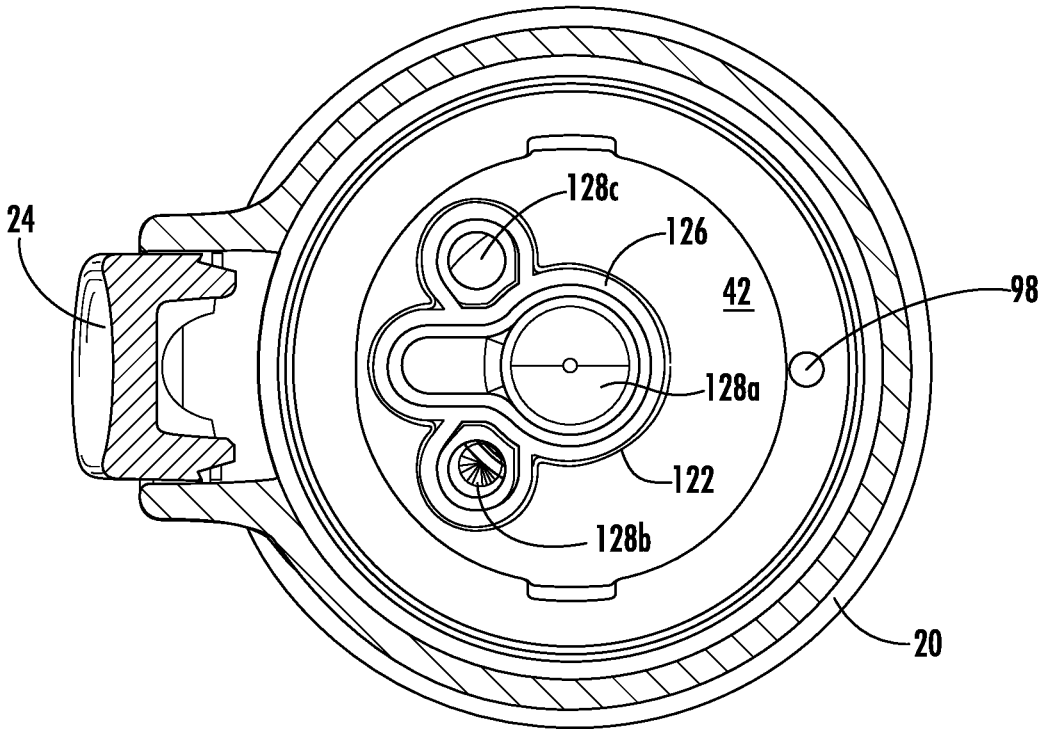
FIG. 9 is a top cross-sectional view of the sprayhead through line 9-9 of FIG. 4.

Referring to FIG. 9, the cartridge body 42 includes one or more grooves, generally referred to as groove 122, formed in a surface or face 124 of the cartridge body 42. The face 124 is adjacent to and couples to the outlet side 114 of the outlet disc 110. The one or more grooves 122 are configured to receive one or more seals, generally referred to as seal 126, which are located between the cartridge body 42 and the outlet disc 110 and seal each fluid outlet path from one another.

Figure 10:
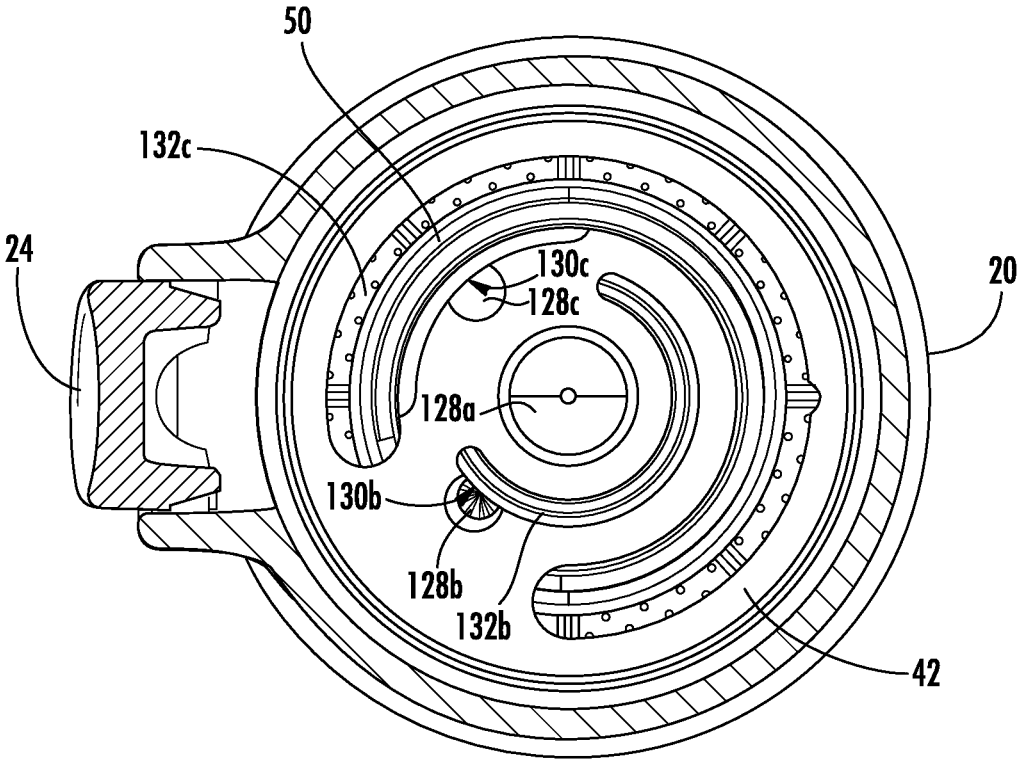
FIG. 10 is a top cross-sectional view of the sprayhead through line 10-10 of FIG. 4.
Figure 11:
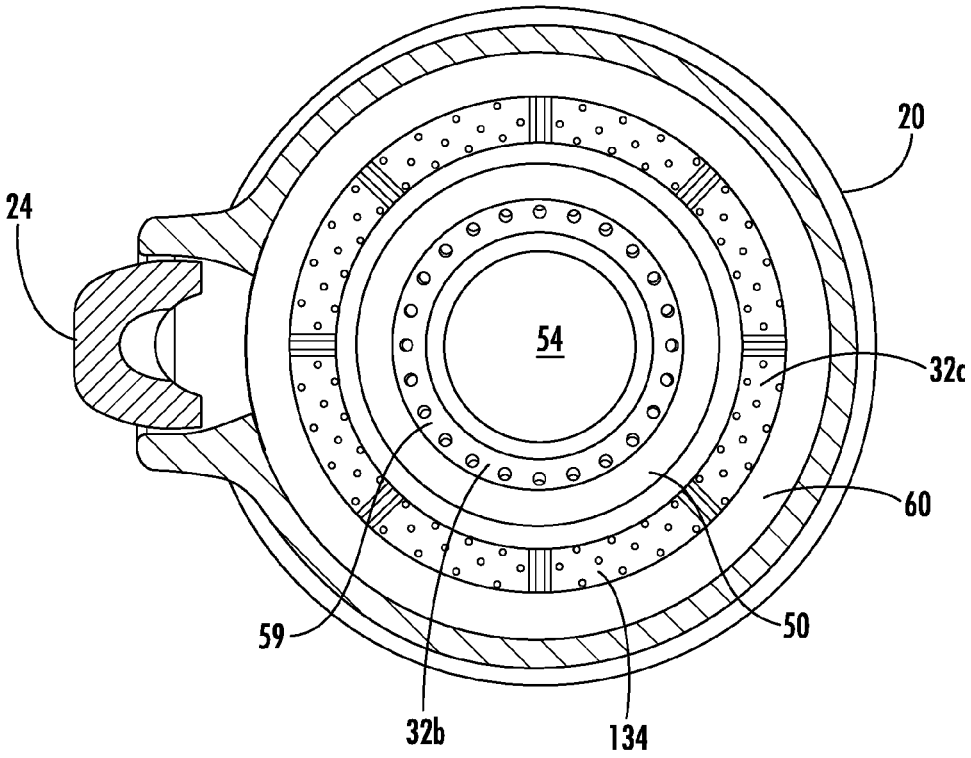
FIG. 11 is a top cross-sectional view of the sprayhead through line 11-11 of FIG. 4.

Referring to FIGS. 10 and 11, the cartridge body 42 includes a plurality of passageways 128, shown as first bore 128*a*, second bore 128*b*, and third bore 128*c*, which transport fluid from the outlet disc 110 toward the respective outlet 32*a*, 32*b*, 32*c*.

The first bore 128*a* extends axially from the face 124, where it junctions with the first outlet port 120*a*, to a bottom end of the cartridge body 42, shown to be in the inner portion 44 thereof, where it fluidly couples with the internal bore 54 of the adapter 50. The second bore 128*b* extends axially downward from the face 124 where it junctions with the second outlet port 120*b* of the outlet disc 110. According to the exemplary embodiment shown, an opening 130*b* is formed on an inner side of the bore wall such that the second bore 128*b* communicates with an annular inner chamber 132*b*, which allows the fluid to distribute circumferentially around the sprayhead 10. The third bore 128*c* extends axially downward from the face 124 where it junctions with the third outlet port 120*c* of the outlet disc 110. According to the exemplary embodiment shown, an opening 84*c* is formed on an outer side of the bore wall such that the third bore 128*c* communicates with an annular outer chamber 132*c*, which allows the fluid passing therethrough to distribute circumferentially around the sprayhead 10. The outer chamber 132*c* defines an opening at the bottom thereof, which empties into a chamber 134 of the cartridge bottom 60, which provides fluid to the third outlet 32*c*. A seal 136 is retained between the inner portion 44 and the adapter 50 to prevent fluid from outer chamber 132*c* from entering the adapter 50.

The adapter 50 is located between cartridge body 42 and the cartridge bottom 60. The adapter 50 is shown to include an inner wall 56 and an outer wall 57 joined by a flange or web 58, defines the orifices 34*b* of the second outlet 32*b*. A chamber 59 is defined between the inner wall 56 and the outer wall 57. The chamber 59 is fluidly coupled to, and receives fluid from, the inner chamber 132*b* of the cartridge body 42. Fluid drains from the chamber 59 through orifices 34*b* of the second outlet 32*b*.

The inner wall 56 of the adapter 50 defines the internal bore 54 which receives and supports the aerator 52. Fluid flowing to the aerator 52 exits the sprayhead 10 via the first outlet 32*a*. According to the exemplary embodiment shown, the outer wall 57 of the adapter 50 and the outer portion 46 of the cartridge body 42 define the outer chamber 132*c*.

The construction and arrangement of the elements of the sprayhead as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A fluid control valve, comprising:

a first disc including:

a first outlet port coupled to a first outlet;

a second outlet port coupled to a second outlet; and third outlet port coupled to a third outlet;

a fluid inlet; and a second disc slidably coupled to the first disc and movable relative thereto, the second disc located between the fluid inlet and the first disc;

wherein movement in a first direction of the second disc relative to the first disc fluidly couples the fluid inlet to at least one of the first outlet port, the second outlet port, and the third outlet port, and wherein movement in a second direction of the second disc relative to the first disc controls a volume of fluid flowing through the fluid control valve, wherein the second direction is a radial direction.

2. The fluid control valve of claim 1, wherein the second disc comprises:

a first side adjacent the first disc;

a second side opposite the first side;

wherein the second disc defines a bore fluidly coupled to the fluid inlet and extending from the second side at least partially through the second disc; and wherein the second disc defines a channel extending radially along the first side, the channel having a first end fluidly coupled to the bore.

3. The fluid control valve of claim 2, wherein when the second disc moves in the first direction relative to the first disc, the channel radially aligns with at least one of the first outlet port, the second outlet port, and the third outlet port.

4. The fluid control valve of claim 2, wherein the channel includes a second end opposite the first end, and wherein when the second disc moves in the second direction relative to the first disc, the second end passes over the at least one of the outlet ports such that the channel progressively overlaps the at least one of the outlet ports.

5. The fluid control valve of claim 4, wherein when the second disc moves in a direction opposite the second direction relative to the first disc, the second end passes over the at least one of the outlet ports such that an overlap between the channel and the at least one of the outlet ports progressively diminishes.

6. The fluid control valve of claim 1, wherein the first direction is a rotational direction.

* * * * *